US011311088B2

(12) United States Patent
Harrell-Ross

(10) Patent No.: US 11,311,088 B2
(45) Date of Patent: Apr. 26, 2022

(54) PENCIL SHARPENER

(71) Applicant: Hilda Harrell-Ross, St. Petersburg, FL (US)

(72) Inventor: Hilda Harrell-Ross, St. Petersburg, FL (US)

( * ) Notice: Subject to any disclaimer, the term of this patent is extended or adjusted under 35 U.S.C. 154(b) by 0 days.

(21) Appl. No.: 16/715,586

(22) Filed: Dec. 16, 2019

(65) Prior Publication Data

US 2021/0177117 A1 Jun. 17, 2021

(51) Int. Cl.
*A45C 11/34* (2006.01)
*B43L 23/00* (2006.01)

(52) U.S. Cl.
CPC ..... *A45C 11/34* (2013.01); *B43L 23/00* (2013.01)

(58) Field of Classification Search
CPC ..... A45C 11/34; B43L 23/00; B43L 23/002; B43L 23/004
USPC ..... 30/451
See application file for complete search history.

(56) References Cited

U.S. PATENT DOCUMENTS

| | | | | |
|---|---|---|---|---|
| 5,826,770 | A * | 10/1998 | Chuang | A45C 11/34 224/607 |
| 7,273,079 | B2 | 9/2007 | Kok | |
| 7,581,573 | B2 | 9/2009 | Hu | |
| 7,699,082 | B2 | 4/2010 | Peng | |
| D645,514 | S | 9/2011 | Sued et al. | |
| 8,118,071 | B2 | 2/2012 | Sued et al. | |
| 10,905,212 | B2 * | 2/2021 | Song | A45C 13/02 |
| 2008/0053569 | A1 | 3/2008 | Ko | |
| 2015/0000791 | A1 | 1/2015 | Zhong et al. | |
| 2016/0214424 | A1 * | 7/2016 | Ball | G07F 11/005 |
| 2016/0353849 | A1 * | 12/2016 | Macadaan | A45C 11/24 |
| 2017/0340079 | A1 * | 11/2017 | Yang | A45C 11/34 |
| 2020/0187616 | A1 * | 6/2020 | Song | A45C 11/34 |
| 2020/0331286 | A1 * | 10/2020 | Lavasanijou | B25C 5/0214 |

* cited by examiner

*Primary Examiner* — Omar Flores Sanchez

(57) ABSTRACT

An illustrated view of an exemplary pencil sharpener for sharpening pencils is presented. The pencil sharpener is useful for sharpening one or more pencils during a single event. Also, the pencil sharpener is useful for storing one or more pencils in a convenient location to be sharpened immediately or at other determined times and intervals.

10 Claims, 1 Drawing Sheet

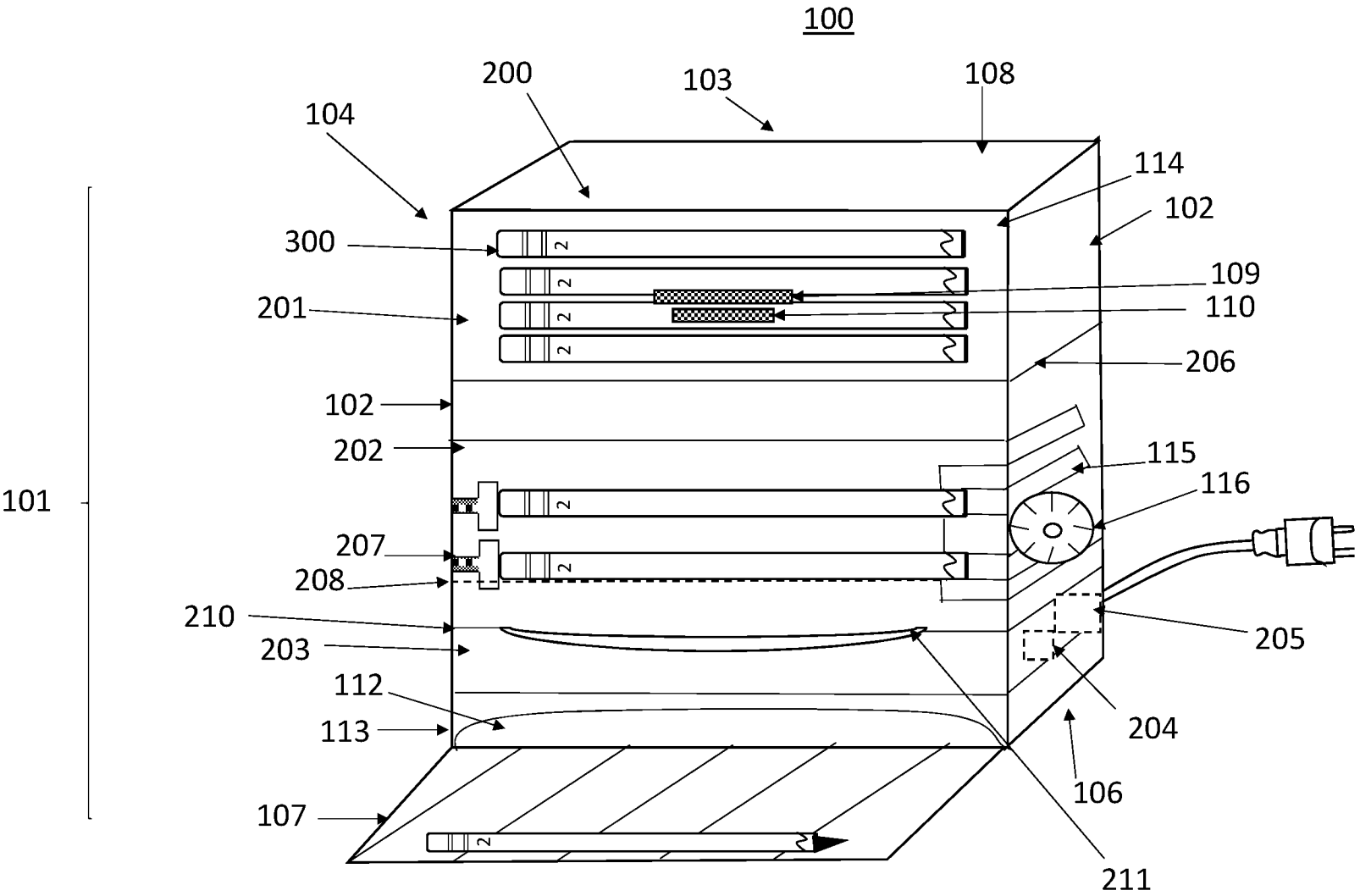
100
101
102
103
104
106
107
108
109
110
112
113
114
115
116
200
201
202
203
204
205
206
207
208
210
211
300

PENCIL SHARPENER

FIELD OF THE INVENTION

This invention relates to pencil sharpeners. More particularly, it relates pencil sharpeners that can sharpen more than one pencil at a time.

BACKGROUND

A pencil sharpener (also referred to as pencil pointer or in Ireland as a parer or topper) is a tool for sharpening a pencil's writing point by shaving away its worn surface. Pencil sharpeners may be operated manually or by an electric motor. It is common for many sharpeners to have a casing around them, which can be removed for emptying the pencil shavings debris into a trash bin.

Electric pencil sharpeners were introduced by 1940. They work on the same principle as manual ones, but one or more flat-bladed or cylindrical cutters are rotated by an electric motor. Some electric pencil sharpeners are powered by batteries rather than being plugged into a building's electrical system, making them more portable.

Auto-stop electric pencil sharpeners are able to sense when the tip of the pencil is long enough, so they stop automatically. In basic automatic pencil sharpeners, the lead may become too long and break, and so users must be careful to supervise the operation.

Specialized sharpeners are available that operate on non-standard sizes of pencil-shaped markers, such as wax crayons used in primary schools. Sharpeners that have two openings, one for normal pencils and one for larger crayons, are fairly common. Sharpeners with a single blade for use on wax crayons are available, and sometimes included in boxes of crayons. These often have plastic blades, which are adequate for the soft wax.

An artist's or draftsman's pencil sharpener leaves the graphite untouched and sharpens only the wood (some models can switch from standard to wood-only by an adjustment). The graphite lead is then honed to a sharp point with a lead pointer, which sharpens only the lead without wood. Lead pointers are also used with mechanical lead holders, which have removable/refillable leads. Some sharpeners which function as a long point sharpener, have a second hole in which the blade sharpens the untouched graphite to a long, more precise point than would be otherwise possible using a single hole long point sharpener.

Carpenters may use carpenter pencils, the flattened shape of which stops them from rolling away, while still providing a constant line width. These pencils were traditionally sharpened with tools conveniently to hand, such as a plane or sandpaper. Rotating pencil sharpeners are now available for these, in which a rotating plastic collar holds the pencil in position, although they then sharpen them to the usual conical point as for a round pencil, abandoning some distinctive aspects of the carpenter's pencil.

Mechanical pencils dispense the graphite lead progressively during use and thus do not require sharpening; such pencils are sometimes called "self-sharpening". A type of mechanical pencil has a rotating gear mechanism which rotates the lead slightly every time the lead is lifted off the paper, helping to maintain a consistent, sharp point. If a finer or broader line is needed, a separate mechanical pencil using a lead with a different diameter is required.

Pencil sharpeners are limited by the number of pencils, types and shapes that a pencil can be sharpened. A teacher may desire to have different sized pencils, larger number of pencils, to change the shape of the pencil, etc. These are not currently available or thought of.

In light of the foregoing, it would be desirable to devise an improved pencil sharpener that can sharpen one or more pencils at a single time. It would be further advantageous if the device were able to store more than one pencil while sharpening the one or more pencils.

BRIEF DESCRIPTION OF THE DRAWINGS

FIG. 1 is an illustrated view of an exemplary pencil sharpener.

DETAILED DESCRIPTION

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, an illustrated view of an exemplary pencil sharpener 100 for sharpening pencils is presented. The pencil sharpener 100 is useful for sharpening one or more pencils during a single event. Also, the pencil sharpener 100 is useful for storing one or more pencils in a convenient location to be sharpened immediately or at other determined times and intervals.

The pencil sharpener 100 has a body 101. The pencil sharpener 100 is preferably nine (9) inches in length, however other lengths are hereby contemplated, including, but not limited to, seven (7) inches, ten (10) inches, etc. The pencil sharpener 100 is preferably nine (9) inches in width, however other widths are hereby contemplated, including, but not limited to, seven (7) inches, ten (10) inches, etc. The pencil sharpener 100 is preferably nine (9) inches in height, however other heights are hereby contemplated, including, but not limited to, seven (7) inches, ten (10) inches, etc.

The pencil sharpener 100 is preferably a square shape, however other shapes are hereby contemplated, including, but not limited to, rectangular, trapezoidal, etc. The pencil sharpener 100 is preferably made of a plastic material, however other materials are hereby contemplated, including, but not limited to, glass, poly-vinyl chloride (PVC), etc. The pencil sharpener 100 is preferably a blue color, however other colors are hereby contemplated, including, but not limited to, yellow, purple, red, etc. The pencil sharpener 100 is preferably a transparent view, however other views are hereby contemplated, including, but not limited to, clear, opaque, non-see through, etc.

The body 101 of the pencil sharpener 100 has a first side 102, a second side 103, a third side 104, a fourth side 105, a bottom 106, a tray 107, a top 108 and an interior 200. The top 208 of the body 101 of the pencil sharpener 100 is open. The interior 200 of the body 101 is accessible through the top 108 of the body 101.

The interior 200 of the body 101 has a first section 201, a second section 202, a third section 203, a computing device 204 and a power source 205.

The first section 201 of the interior 200 of the body 101 has a bottom 206. The first section 201 of the interior 200 of the body 101 is hollow. The first section 201 of the interior 200 of the body 101 is configured to have a capacity to store one or more pencils 300. The capacity of pencils 300 of the first section 201 of the interior 200 of the body are preferably forty (40) pencils, however other capacities are hereby contemplated, including, but not limited to, twenty (20) pencils, fifty (50) pencils, etc.

The bottom 206 of the first section 201 of the interior 200 of the body 101 of the pencil sharpener 100 is preferably retractable, where the retraction of the bottom 206 of the interior 200 is preferably one (1) pencil width, however other widths are hereby contemplated, including, but not limited to, two (2) pencils, etc.

Opening and closing of the bottom 206 of the first section 201 of the interior 200 is controlled by the computing device 204. The computing device 204 is thus communicatively coupled to the bottom 206 of the interior 200. The computing device 204 is electrically coupled further to the power source 205. The power source 205 providing electrical current to the computing device 204. The power source 205 is preferably AC/DC, however other types of power sources are hereby contemplated, including, but not limited to, solar, rechargeable battery, disposable battery, etc.

The second section 202 has one or more pressing devices 207 and one or more pencil holders 208. The pressing devices 207 are preferably spring loaded. The pressing devices 207 are preferably retractable. The pressing devices 207 are coupled to the interior 200 of the fourth side 105 of the body 101.

Each of the pencil holders 208 of the second section 202 are useful for receiving the pencils 300 released from the first section 201 of the interior 200. Each of the pencil holders 208 are configured to place the pencil 300 into a determined position for sharpening. The pencil holders 208 are communicatively coupled to the computing device 204. The pencil holders 208 are opened to release the pencil 300 and closed to receive the pencil 300.

A bottom 210 of the second section 202 of the interior 200 is configured to have an opening 211. The opening 211 of the bottom of the second section is preferably of a size to allow a single pencil 300 to be released to the third section 203 of the interior 200.

The third section 203 receives the pencils 300 when released from the second section 202 of the interior 200. The third section 203 is hollow. The pencils 300 travel through the third section 203 to be released one at a time to the tray 107 of the body 101.

The first side 102 of the body 101 of the pencil sharpener 100 has a first button 109, a second button 110, an opening 112, a bottom 113 and a top 114.

The first button 109, the second button 110 and the third button 111 are communicably coupled to the computing device 204.

The first button 109 is coupled to significantly near the top 114 of the first side 102 of the body 101. When pushed, the first button 109 sends a signal to the computing device 204 to release open the bottom 206 of the interior 200. One of the pencils 300 is released and received by the of the pencil holders 208 of the second section 202.

The received pencil 300 is configured to be aligned with a pencil sharpener 115 coupled to the second side 103 of the body 101 or a shape changer 113 coupled to the second side 103 of the body 101.

The pressing device 207 of the second section 202 of the interior 200 is released to hold the pencil 300 in a predetermined position.

The second button 110 is coupled to significantly near the first button 110 significantly near the top 114 of the first side 102 of the body 101. When the second button 110 is actuated, the second button 110 is configured to signal to the computing device 204 to sharpen the pencil 300.

The pressing device 207 is in contact with the pencil 300. The computing device 204 actuates the pencil sharpener 115 or a shape changer 116. The pencil 300 is configured to enter the pencil sharpener 115 or the shape changer 116 which either sharpens or changes the shape of the pencil 300.

When the sharpener 115 or the shape changer 116 detects completion of its task, the sharpener 115 or the shape changer 116 is configured to send a signal to the computing device 204 to de-actuate the sharpener 115 or the shape changer 116 and release the pressing device 207 and the pencil holder 208 is opened to release the pencil 300.

The bottom 210 of the second section 202 of the interior 200 is configured to have an opening 211 where the pencil 300 is released into the third section 203 of the interior 200. The pencil 300 travels through the third section and is configured to release through the opening 112 configured on the bottom 113 of the first side 102. The tray 107 coupled to the opening 112 of the bottom 113 of the first side 102 receives the pencil 300. The pencil 300 is then available to be used.

The next pencil 300 or a plurality of pencils 300 can then be sharpened and/or shape changed in the same manner.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The inventor claims:

1. A pencil sharpener for sharpening pencils, the sharpener comprising:

a body, the body having a first side, a second side, a third side, a fourth side, a top, an interior and a bottom;

the interior comprising:

a first section, the first section having a capacity to store pencils, wherein the first section having a bottom, the bottom being coupled to a computing device and wherein the computing device being coupled to a power source;

a second section, the second section comprising:

one or more pressing devices, the pressing devices for pressing the pencils, wherein the one or more pressing devices being coupled to the computing device;

one or more pencil holders, the pencil holders being for receiving one of the pencils from the first section, wherein the one or more pencil holders being coupled to the computing device;

a bottom, the bottom having an opening for releasing each of the pencils;

a third sections, the third section being for receiving each of the pencils from the second section, wherein the third section releasing the pencils through an opening near the bottom of the first side;

a tray, the tray coupled to the opening of the first side, the tray for receiving pencils;

a first button, the first button being communicatively coupled to the computing device, the first button for releasing a pencil from the first section to the second section;

a second button, the second button communicatively coupled to the computing device, the second button for activating a sharpener coupled to the second side of the body; and wherein the computing device being for opening the bottom of the first section to release the pencils, and wherein the computing device for opening the pencil holders of the second section for releasing the pencils to the third section.

2. The sharpener of claim 1, wherein the pencil sharpener having a length being nine (9) inches.

3. The sharpener of claim 1, wherein the pencil sharpener having a width being nine (9) inches.

4. The sharpener of claim 1, wherein the pencil sharpener having a height being nine (9) inches.

5. The sharpener of claim 1, wherein the pencil sharpener being a square shape.

6. The sharpener of claim 1, wherein the pencil sharpener being transparent.

7. The sharpener of claim 1, wherein the pencil sharpener being made of a plastic material.

8. The sharpener of claim 1, wherein the power source being AC/DC.

9. The sharpener of claim 1, wherein the top of the body being open.

10. The sharpener of claim 1, wherein the first section being hollow.

* * * * *